US011541654B2

(12) United States Patent
Watari et al.

(10) Patent No.: US 11,541,654 B2
(45) Date of Patent: Jan. 3, 2023

(54) INKJET RECORDING DEVICE AND METHOD FOR CONTROLLING INKJET RECORDING DEVICE

(71) Applicant: Hitachi Industrial Equipment Systems Co., Ltd., Tokyo (JP)

(72) Inventors: Takao Watari, Tokyo (JP); Mitsuo Igari, Tokyo (JP); Takahiro Arima, Tokyo (JP)

(73) Assignee: HITACHI INDUSTRIAL EQUIPMENT SYSTEMS CO., LTD., Tokyo (JP)

( * ) Notice: Subject to any disclaimer, the term of this patent is extended or adjusted under 35 U.S.C. 154(b) by 0 days.

(21) Appl. No.: 17/424,524

(22) PCT Filed: Jan. 28, 2020

(86) PCT No.: PCT/JP2020/003046
§ 371 (c)(1),
(2) Date: Jul. 21, 2021

(87) PCT Pub. No.: WO2020/158759
PCT Pub. Date: Aug. 6, 2020

(65) Prior Publication Data

US 2022/0072847 A1 Mar. 10, 2022

(30) Foreign Application Priority Data

Jan. 29, 2019 (JP) ..... JP2019-012986

(51) Int. Cl.
*B41J 2/03* (2006.01)
*B41J 2/035* (2006.01)
(Continued)

(52) U.S. Cl.
CPC ..... *B41J 2/035* (2013.01); *B41J 2/04563* (2013.01); *B41J 2/04571* (2013.01);
(Continued)

(58) Field of Classification Search
CPC .... B41J 2/04503; B41J 2/04573; B41J 2/035; B41J 2/072; B41J 2/085; B41J 2002/033;
(Continued)

(56) References Cited

U.S. PATENT DOCUMENTS

2004/0070651 A1 4/2004 Usui et al.
2017/0274667 A1 9/2017 Pagnon et al.

FOREIGN PATENT DOCUMENTS

EP 0 333 325 A2 9/1989
EP 2 695 654 A2 2/2014
(Continued)

OTHER PUBLICATIONS

International Search Report of PCT/JP2020/003046 dated Apr. 14, 2020.

(Continued)

*Primary Examiner* — Kristal Feggins
(74) *Attorney, Agent, or Firm* — Mattingly & Malur, PC

(57) ABSTRACT

An inkjet recording device and a method for controlling an inkjet recording device are provided. A heating device that heats the ink to be supplied to a nozzle immediately ahead of the nozzle, a thermometer that detects a temperature of the ink inside the heating device or after heating, a viscometer that detects a viscosity of the ink in a main ink container are provided. The heating device is driven using a detection value of the thermometer to control the temperature of the ink such that the viscosity reaches an ink viscosity which enables normal printing, and when the viscosity of the ink is out of a range which enables printing, the solvent or the replenishment ink is supplied to the main ink container using a detection value of the viscometer such that the viscosity reaches the range which enables normal printing.

10 Claims, 15 Drawing Sheets

(51) Int. Cl.

| | |
|---|---|
| ***B41J 2/07*** | (2006.01) |
| ***B41J 2/125*** | (2006.01) |
| ***B41J 2/045*** | (2006.01) |
| ***B41J 2/09*** | (2006.01) |
| ***B41J 2/17*** | (2006.01) |
| ***B41J 2/085*** | (2006.01) |
| *B41J 2/02* | (2006.01) |

(52) U.S. Cl.
CPC ..... *B41J 2/04586* (2013.01); *B41J 2/072* (2013.01); *B41J 2/085* (2013.01); *B41J 2/09* (2013.01); *B41J 2/125* (2013.01); *B41J 2/1721* (2013.01); *B41J 2002/022* (2013.01)

(58) Field of Classification Search
CPC ..... B41J 2002/022; B41J 2002/1853; B41J 2/185; B41J 2/195; B41J 2/125; B41J 2/1721; B41J 2/03; B41J 2/1707; B41J 2/18; B41J 2/09; B41J 2/07; B41J 2/02
See application file for complete search history.

(56) References Cited

FOREIGN PATENT DOCUMENTS

| | | | |
|---|---|---|---|
| JP | 58-016851 | A | 1/1983 |
| JP | 2002-59563 | A | 2/2002 |
| JP | 2004-66499 | A | 3/2004 |
| JP | 2008-137198 | A | 6/2008 |
| JP | 2009-179023 | A | 8/2009 |
| JP | 2015-85513 | A | 5/2015 |

OTHER PUBLICATIONS

Extended European Search Report received in corresponding European Application No. 20748716.6 dated Sep. 26, 2022.

INKJET RECORDING DEVICE AND METHOD FOR CONTROLLING INKJET RECORDING DEVICE

TECHNICAL FIELD

The present invention relates to an inkjet recording device and a method for controlling an inkjet recording device.

BACKGROUND ART

In an inkjet recording device used for industrial purposes, an ink continuously ejected is changed into ink particles by a nozzle body, an electric charge corresponding to printing characters is then applied to the ink particles by a charging electrode, the ink particles charged with the electric charge are changed by a deflection electrode to fly, and the ink lands on a printing object to print the characters. In the printing, the homogeneity of the ink particles ejected from the nozzle body greatly affects the printing quality. In order to maintain the homogeneity of the ink particles, it is necessary to regulate the ink viscosity in a range in which characters can be normally printed.

JP S58-16851 A (Patent Document 1) discloses the background art related to the technical field. In this publication, a preheating device is provided in an ink tube at the previous stage of a print head, and control is performed such that an ink which flows into the print head at an ink temperature is preheated (heated) to cause the ink temperature to reach a set value (for example, 15° C.)

CITATION LIST

Patent Document

Patent Document 1: JP S58-16851 A

SUMMARY OF THE INVENTION

Problems to be Solved by the Invention

Various types of inks are used in the inkjet recording device, and in the case of an ink having a large gradient in relationship between ink temperature and ink viscosity, the temperature range is narrow in which the ink viscosity can be controlled to an ink viscosity which enables normal printing. When an ink is used of which the temperature range is narrow in which the ink viscosity that enables normal printing can be reached, the range of ink temperature control by a heating device also is narrow. In addition, in a case where ambient temperature exceeds the set temperature, even when the ink viscosity changes due to the ambient temperature, the ink viscosity cannot be controlled by temperature. Namely, in the technique of Patent Document 1, there is no means for lowering the ink temperature when ambient temperature exceeds a set temperature value, and the ink temperature rises with a rise in ambient temperature, so that the temperature cannot be controlled. When due to a decrease in ink viscosity by the temperature rise, the ink viscosity exceeds the range in which normal printing can be performed, due to the exceedance, both the ejection speed of the ink ejected from a nozzle and the character size change, so that normal printing cannot be performed.

Meanwhile, it is known that the regulation (control) of the ink viscosity is performed by adjusting the amount of a solvent included in the ink. The viscosity of the ink stored in an ink container is detected by a viscometer, and when the detection value is out of the range of ink viscosity (normal range) in which normal printing can be performed, the solvent is supplied to control the ink viscosity of the ink. However, since the ink viscosity control depends on the supply of the solvent which is an intensifying liquid, a large amount of the solvent (intensifying liquid) is used. In addition, in the viscosity control by the supply of the solvent, it takes a lot of time for the ink viscosity to reach a normal value, which is a problem.

Therefore, an object of the present invention is to provide an inkjet recording device and a method for controlling an inkjet recording device, which are capable of reducing the amount of use of a solvent and controlling the ink viscosity in a normal range.

Solutions to Problems

In order to solve the above problem, according to one example of the present invention, there is provided an inkjet recording device including: a nozzle that atomizes an ink to eject ink particles; a charging electrode that charges the ink particles, which have been ejected from the nozzle, to correspond to a printing character; a deflection electrode that deflects the charged ink particles which have passed through the charging electrode; a gutter that captures a non-charged ink; an ink supply path that supplies the ink in a main ink container to the nozzle; an ink recovery path that recovers the non-charged ink, which has been captured by the gutter, to the main ink container; a solvent replenishment unit that supplies a solvent to the main ink container; and a control unit that controls an entirety of the device. A heating device that is installed between the ink supply path and the nozzle to heat the ink, a thermometer that detects an ink temperature of the ink heated by the heating device, and a viscometer that detects a viscosity of the ink in the main ink container are provided. The control unit controls the heating device based on the temperature detected by the thermometer such that the temperature reaches a set temperature set in a range of an ink viscosity which enables printing, and controls an amount of supply of the solvent based on a detection value of the viscometer to regulate the viscosity of the ink in the main ink container to a predetermined ink viscosity.

Effects of the Invention

According to the present invention, temperature control can be performed by the heating device to suppress the amount of use of the solvent and control the ink viscosity in the range which enables normal printing.

MODE FOR CARRYING OUT THE INVENTION

Figure 1:
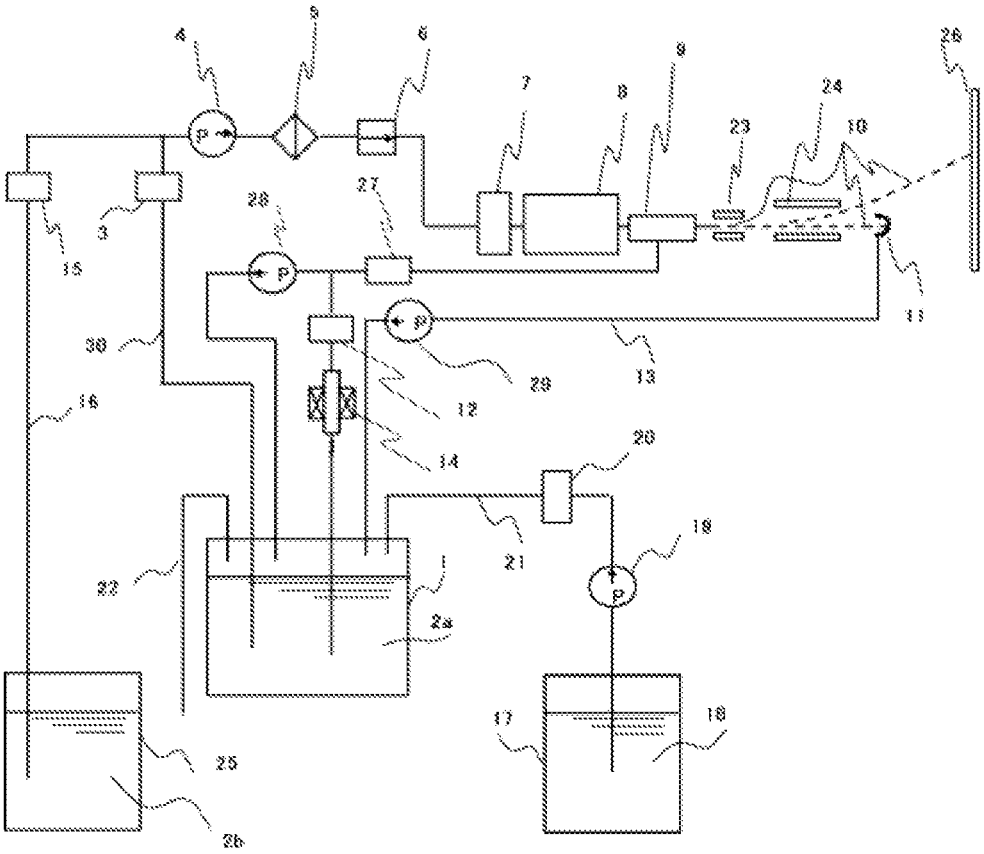
FIG. 1 is a view illustrating an entire configuration of an inkjet recording device according to a first embodiment of the present invention.

Hereinafter, embodiments of the present disclosure will be described with reference to the drawings. Incidentally, the present invention is not limited to the embodiments to be described below. In addition, incidentally, in the drawings referenced in the following description, the same reference signs (numerals) are used for common devices and components, and the description of each device and component which have already been described may be omitted.

First Embodiment

Figure 2:
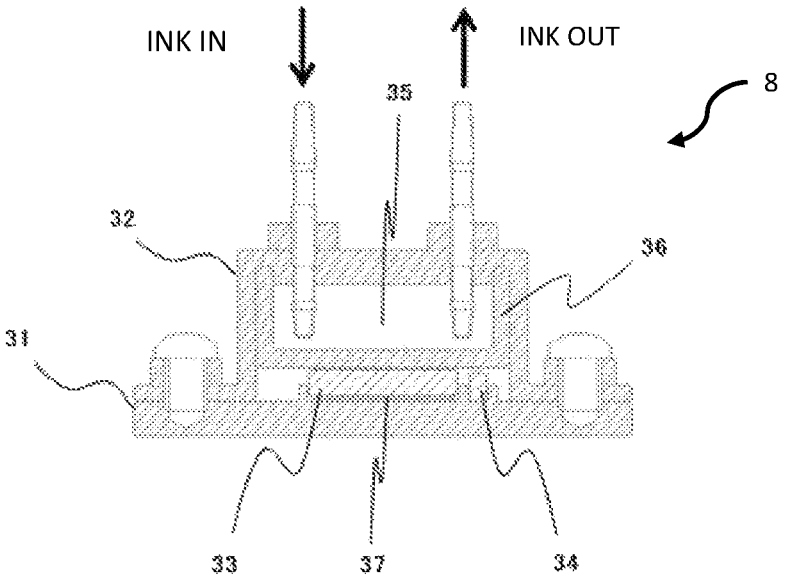
FIG. 2 is a view illustrating a schematic cross-sectional configuration of a heating device according to the first embodiment of the present invention.
Figure 3:
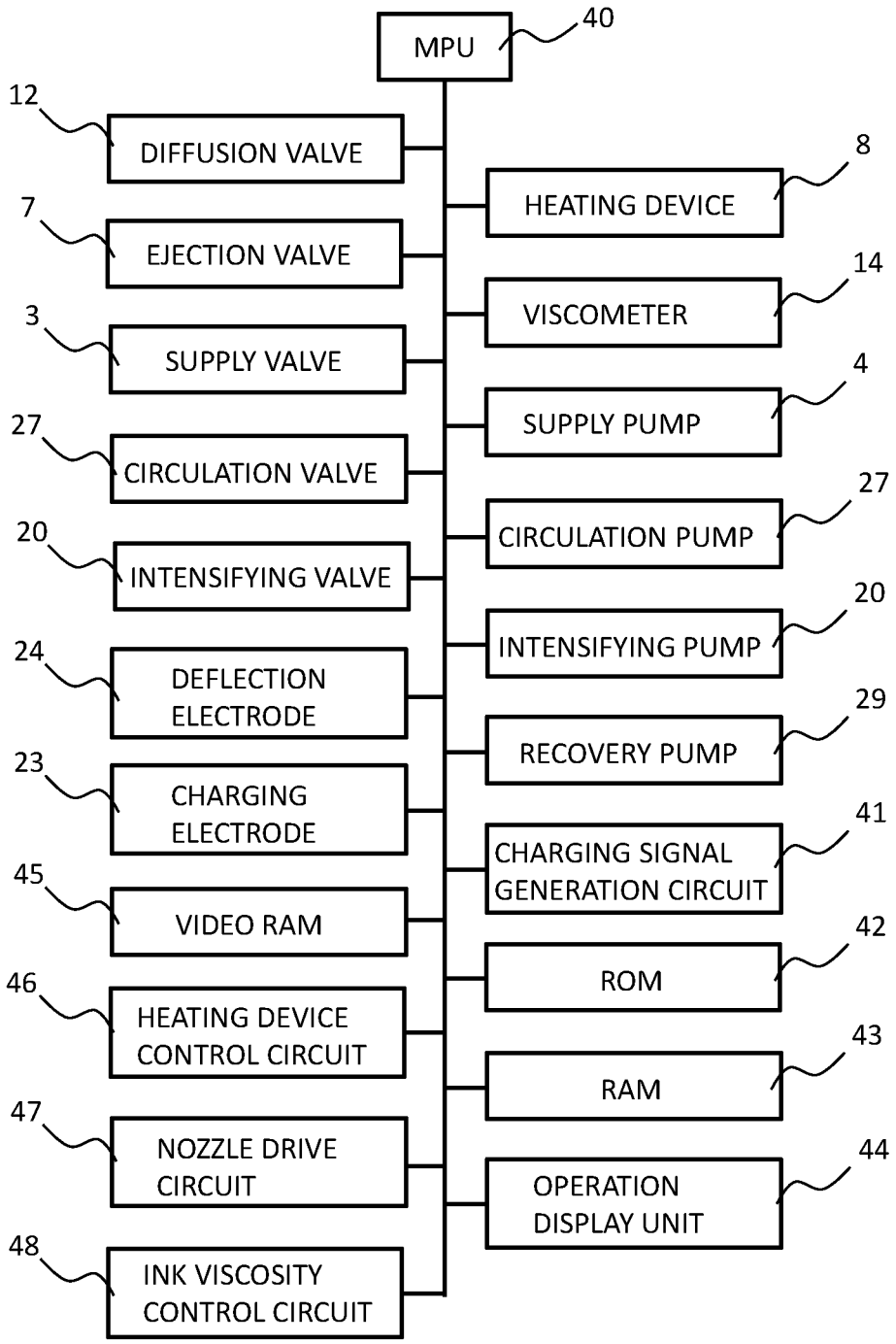
FIG. 3 is a block diagram describing a configuration of a control unit of the inkjet recording device according to the first embodiment of the present invention.
Figure 4:
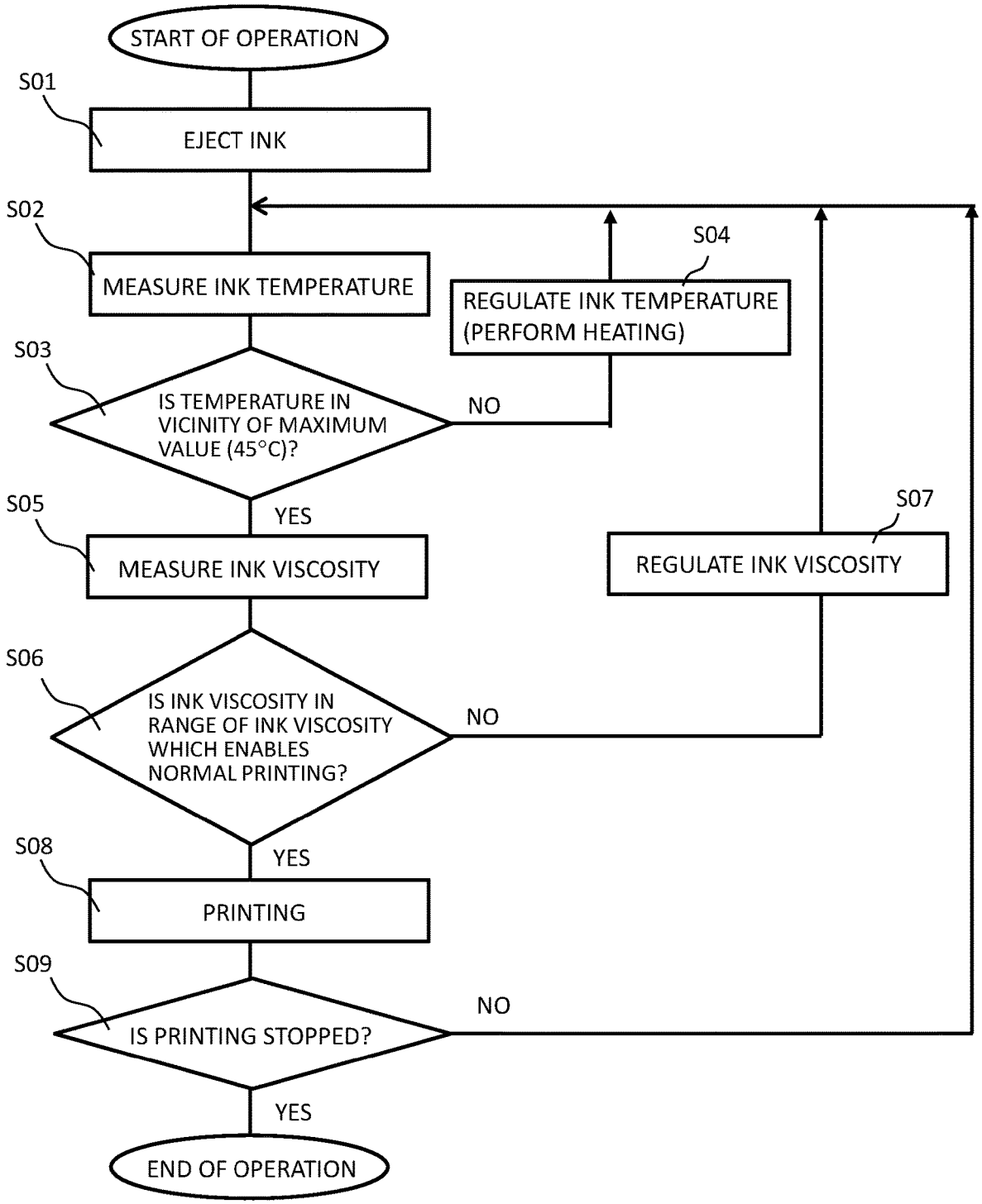
FIG. 4 is a flowchart illustrating control of the inkjet recording device according to the first embodiment of the present invention.

Next, a first embodiment of the present invention will be described with reference to the drawings. FIGS. 1 to 4 are drawings according to the first embodiment of the present invention. Namely, FIG. 1 is a view illustrating an entire configuration in the first embodiment of the present invention. Meanwhile, a part related to a control unit is omitted in FIG. 1. FIG. 2 is a view illustrating a specific configuration of a heating device in FIG. 1. FIG. 3 is a block diagram describing the control unit of an inkjet recording device in the first embodiment. FIG. 4 is a flowchart illustrating control according to the first embodiment of the present invention.

(Description of Entire Configuration)

First, a configuration of the inkjet recording device in the first embodiment of the present invention will be described.

In FIG. 1, a main ink container 1 is filled with an ink 2*a*, and the main ink container 1 is connected to a nozzle 9 via an ink supply path to supply the ink 2*a* to the nozzle 9. Namely, the main ink container 1, a supply valve 3, a supply pump 4, a main filter 5, a pressure regulating valve 6, an ejection valve 7, a heating device 8, and the nozzle 9 are connected to each other by an ink supply pipe 30 to communicate with each other. With such a configuration, the ink 2*a* can be supplied to the nozzle 9.

The ink 2*a* is changed into ink particles by the nozzle 9, and the ink particles flow to a printing object 26 via a charging electrode 23 and a deflection electrode 24, and printing is performed. In the charging electrode 23, the amount of electric charge corresponding to printing characters is applied to the ink particles. The ink particles are deflected according to the amount of electric charge by the deflection electrode 24 to fly and land on the printing object 26.

On the other hand, non-charged ink particles (ink particles to which electric charge is not applied by the charging electrode 23) which are not used for printing travel straight and are captured by a gutter 11. The ink captured by the gutter 11 is recovered to the main ink container 1 via an ink recovery path to be reused. Namely, the gutter 11, a recovery pump 29, and the main ink container 1 are connected to each other by an ink recovery pipe 13. Accordingly, the ink captured by the gutter 11 can be recovered to the main ink container 1.

The viscosity of the ink 2*a* (ink viscosity) in the main ink container 1 is measured (detected) by a viscometer 14 that measures (detects) the viscosity of the ink. The viscometer 14 in this embodiment is provided in the middle of an ink path that starts from the main ink container 1 to return to the main ink container 1 via a diffusion valve 12 and a circulation pump 28. Incidentally, the viscometer 14 may be provided in the middle of the ink supply path that supplies the ink to the nozzle.

A sub-ink container 25 is filled with a replenishment ink 2*b*, and the replenishment ink 2*b* is connected to a replenishment valve 15, the supply valve 3, and the supply pump 4 by an ink replenishment pipe 16. Such a configuration forms an auxiliary ink supply unit. Incidentally, the auxiliary ink supply unit is not limited to the configuration described in this embodiment, and may have any configuration as long as the configuration enables the supply of an auxiliary ink to the main ink container 1. For example, an ink cartridge may be provided in an upper portion of the main ink container, and the auxiliary ink may be supplied from the ink cartridge. When the liquid level detected by a level gauge not illustrated which detects the ink level in the main ink container 1 is lower than a predetermined liquid level, the replenishment ink 2*b* is supplied to the main ink container 1. In addition, when the ink viscosity (detection value of the viscometer 14) is out of the range of ink viscosity required to perform normal printing, the replenishment ink 2*b* is supplied to the main ink container 1. This control will be described later.

An intensifying liquid container 17 is filled with an intensifying liquid 18. A solvent is used as the intensifying liquid. The intensifying liquid container 17, an intensifying liquid pump 19, an intensifying valve 20, and the main ink container 1 are connected to each by an intensifying liquid replenishment pipe 21 to communicate with each other. Accordingly, a solvent replenishment unit is formed to be able to supply the intensifying liquid (solvent) 18 to the main ink container 1. Incidentally, the solvent replenishment unit is not limited to the configuration described in this embodiment, and may have any configuration as long as the configuration enables the supply of the solvent to the main ink container. In addition, the main ink container 1 is connected to a discharge pipe 22. When the ink viscosity detected by the viscometer 14 is different from a value determined in advance (set), the intensifying liquid 18 is supplied to the main ink container 1 to regulate (control) the viscosity. Incidentally, this control is executed by the control unit to be described later. The supply of the intensifying liquid is performed by a path in which the intensifying liquid container 17, the intensifying liquid pump 19, the intensifying valve 20, and the main ink container 1 are connected to each other by the intensifying liquid replenishment pipe 21.

(Description of Heating Device)

Next, a specific configuration of the heating device 8 in this embodiment will be described with reference to FIG. 2. In FIG. 2, the heating device 8 includes a heating block 31, a block lid 32, a PTC heater 33, a thermistor 34, an ink chamber 35, a heater plate 36, and an elastic member 37. The thermistor 34 detects ink temperature inside the heating device. In a control operation of the embodiment to be described later, the ink temperature is detected by the thermistor 34, and ink temperature inside the nozzle is estimated based on the detection value. However, if the heating device is installed at a position immediately ahead of the nozzle, since the difference between the ink temperature of the heating device and the ink temperature inside the nozzle is not so large, the detected temperature may be used. Incidentally, the ink temperature may be detected by thermometers other than the thermistor. In addition, a thermometer which directly detects ink temperature inside the nozzle may be installed.

In FIG. 2, when the ink flows into the ink chamber 35 from an input port, the ink in the ink chamber is heated by the PTC heater 33 and the heater plate 36. The heated ink flows out from an outlet to be supplied to the nozzle 9. Incidentally, the heating device 8 is not limited to the type illustrated in FIG. 2, and any heating device may be used as long as the heating device has a function of raising the ink temperature and can be attached to the device.

(Description of Control Unit)

Next, a configuration of the control unit which controls the entirety of the device will be described with reference to FIG. 3. The control unit includes a microprocessing unit (MPU) 40 that controls the entirety of the inkjet recording device, a random access memory (RAM) 43 that temporarily stores data in the inkjet recording device, a read only member (ROM) 42 that stores a program or the like in advance, and an operation display unit 44 on which an instruction for an operation is performed or which displays an operation state or the like. In addition, the control unit includes a video RAM 45 that stores video data for charging ink particles 10, a charging signal generation circuit 41 that converts the video data into a charging signal, a nozzle drive circuit 47 that drives the nozzle 9, a heating device control circuit 46 that controls the heating device 8, and an ink viscosity control circuit 48 that controls ink viscosity.

The heating device control circuit 46 controls the ink temperature of the ink, which flows into the heating device 8, based on an instruction (command) of the MPU 40. The ink viscosity control circuit 48 performs control such that the solvent (intensifying liquid) and the replenishment ink are supplied to the main ink container 1 based on the detection value of the viscometer 14 to adjust the ink viscosity at a predetermined value or in a predetermined range. Each of the components is connected to the MPU 40 by a bus, and is controlled according to an instruction of the MPU 31. Incidentally, since the other components in FIG. 3 have already been described, the descriptions will be omitted here.

(Description of Ink Viscosity Control Operation)

Figure 5:
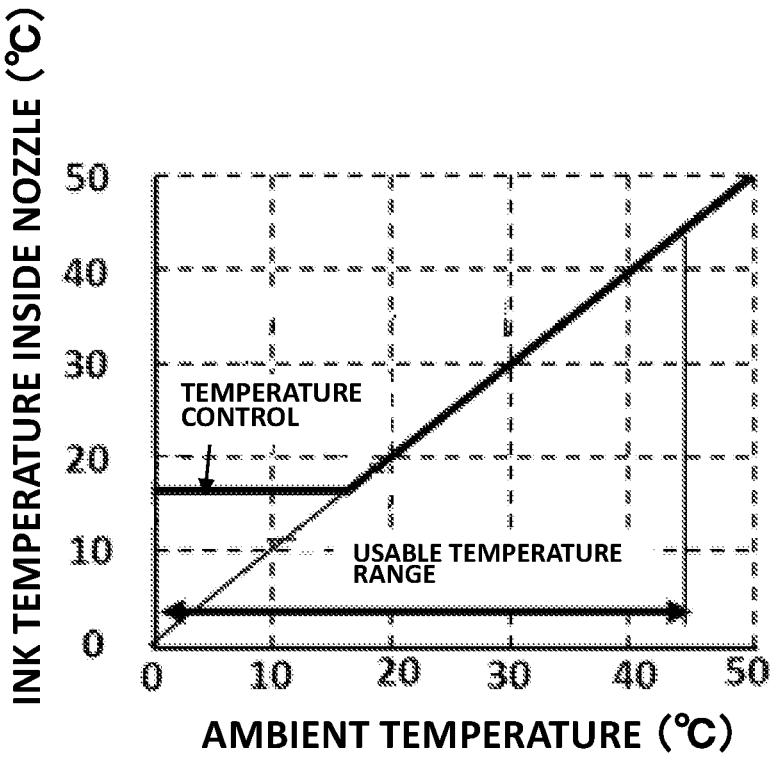
FIG. 5 is a graph showing the control of raising ink temperature when a set value of temperature control is set low.
Figure 6:
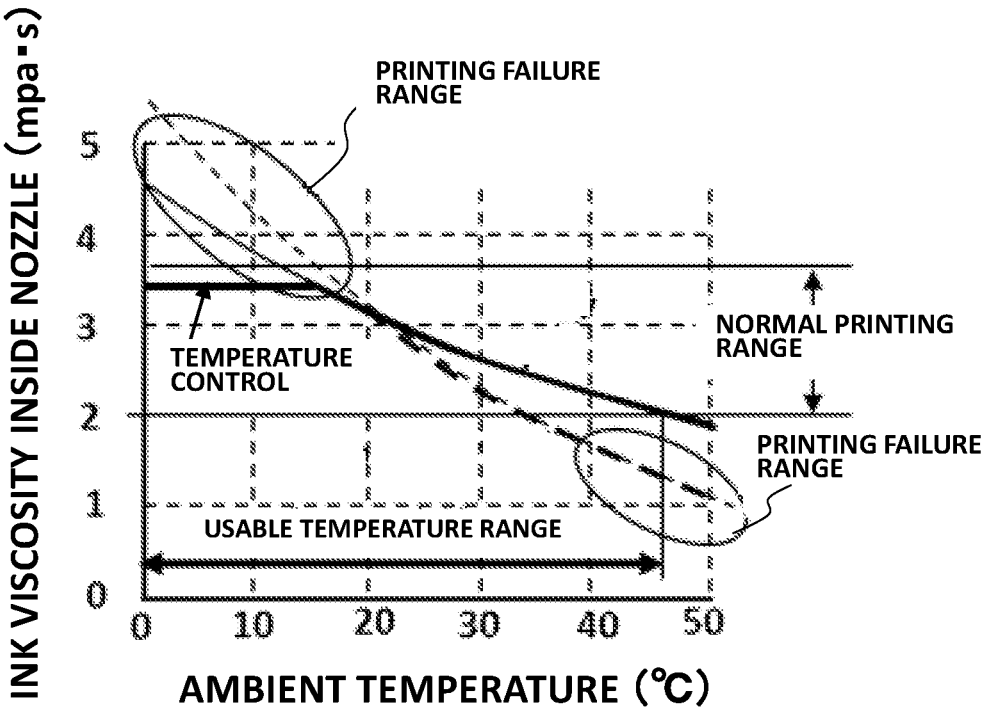
FIG. 6 is a graph showing a relationship between ambient temperature and ink viscosity inside a nozzle when the control of FIG. 5 is performed.
Figure 7:
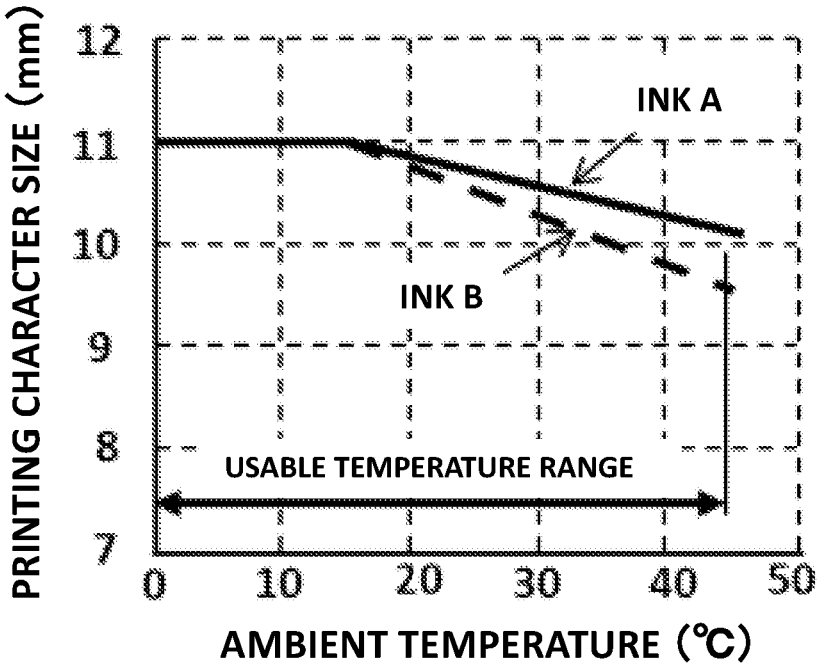
FIG. 7 is a graph showing a relationship between ambient temperature and printing character size when the control of FIG. 5 is executed.
Figure 8:
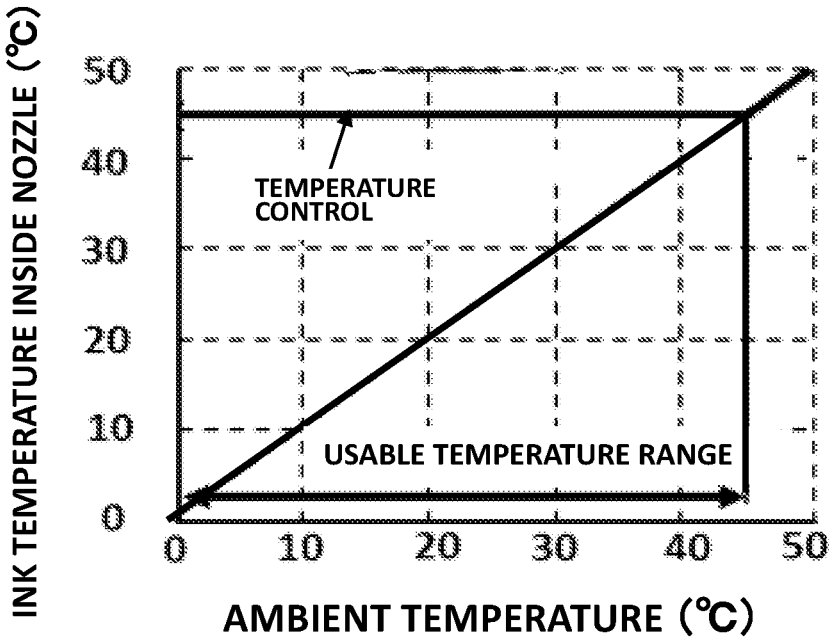
FIG. 8 is a graph showing the control of raising ink temperature when the set value of temperature control is set high.
Figure 9:
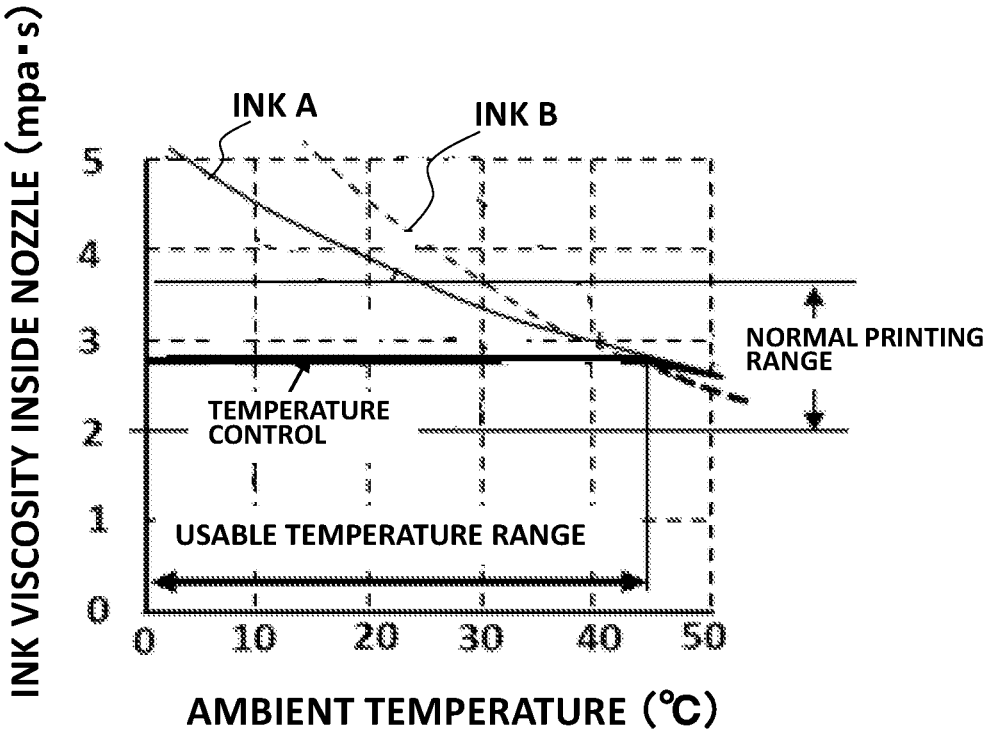
FIG. 9 is a graph showing a relationship between ambient temperature and ink viscosity when the control of FIG. 8 is performed.
Figure 10:
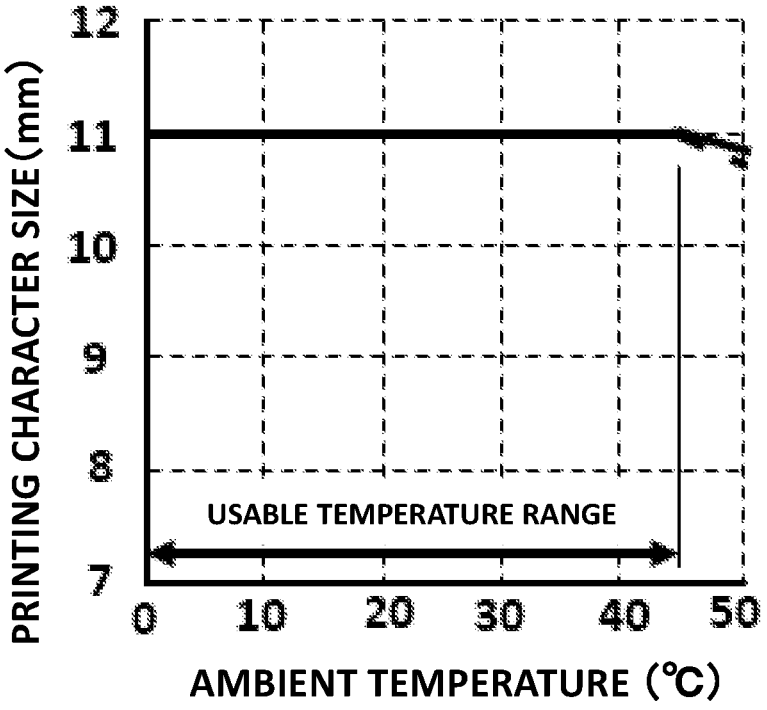
FIG. 10 is a graph showing a relationship between ambient temperature and printing character size when the control of FIG. 8 is performed.
Figure 11:
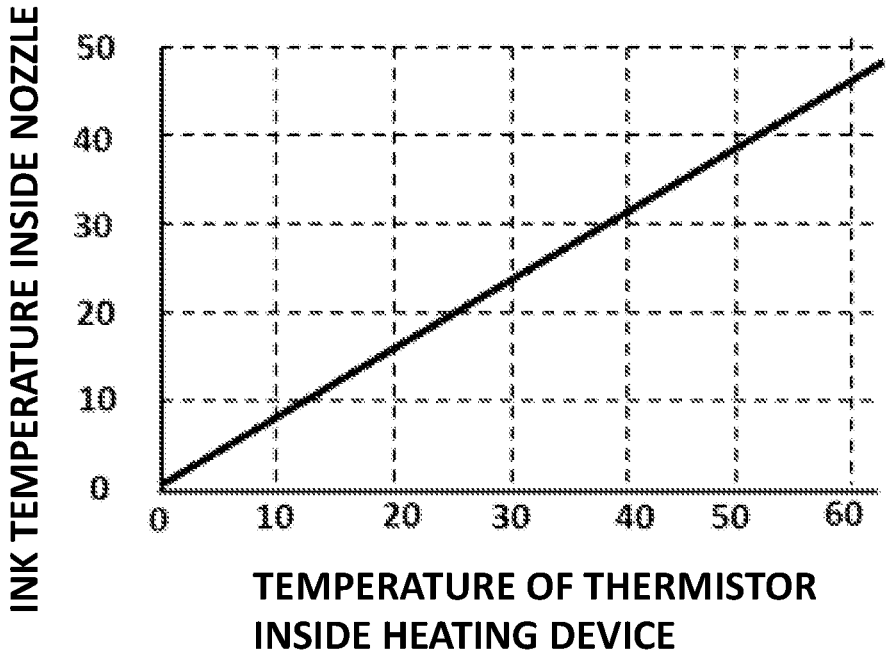
FIG. 11 is a graph showing a relationship between temperature inside the heating device and ink temperature inside the nozzle.
Figure 12:
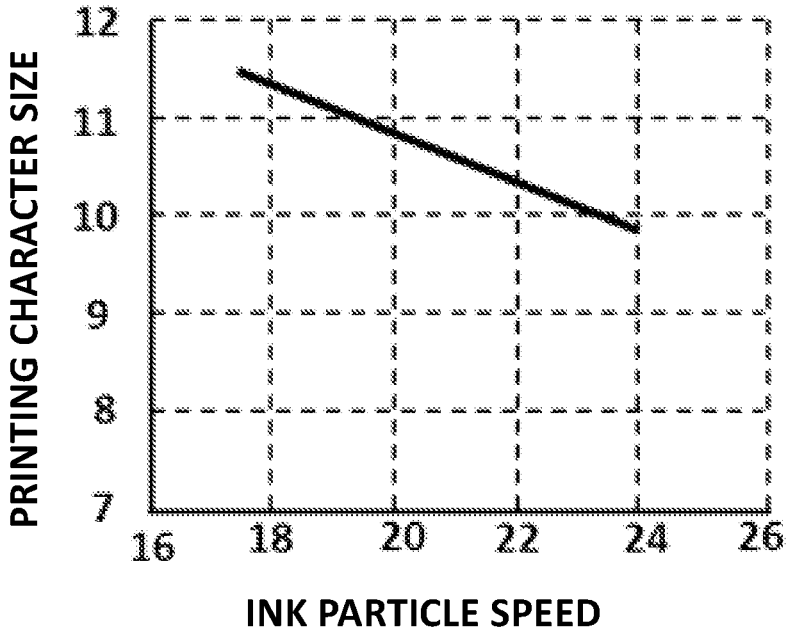
FIG. 12 is a graph showing a relationship between ink particle speed and printing character size.
Figure 13:
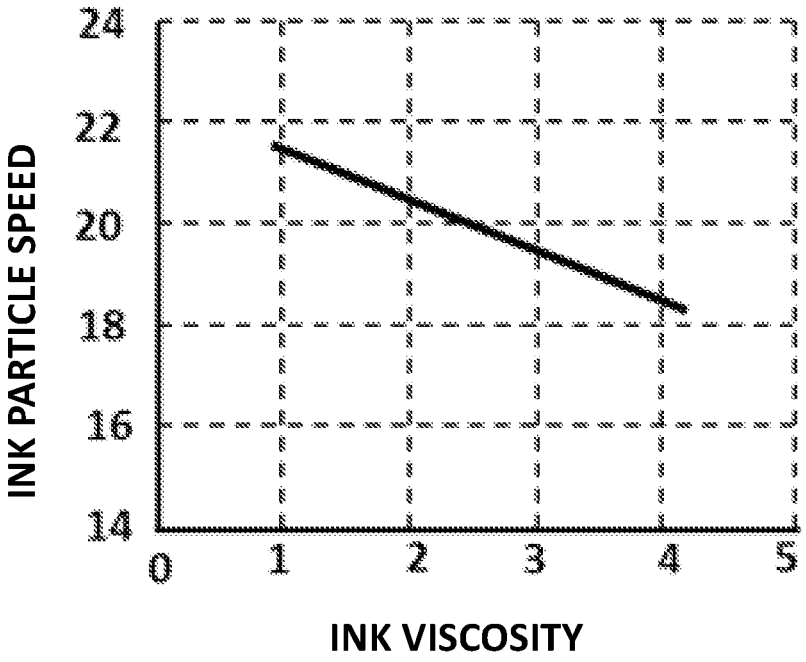
FIG. 13 is a graph showing a relationship between ink viscosity and ink particle speed.

Next, an ink viscosity control operation in one embodiment of the present invention will be described with reference to FIGS. 4 to 13. FIG. 4 is an operation flowchart of one embodiment of the present invention. FIG. 5 is a graph showing a relationship between ambient temperature and ink temperature inside the nozzle when the set value of temperature control is set low to execute ink heating control. FIG. 6 is a graph showing a relationship between ambient temperature and ink viscosity when the control of FIG. 5 is executed. FIG. 7 is a graph showing a relationship between ambient temperature and printing character size when the control of FIG. 5 is executed. FIG. 8 is a graph showing a case where the set value of temperature control is set high to raise ink temperature. FIG. 9 is a graph showing a relationship between ambient temperature and ink viscosity when the control of FIG. 8 is executed. FIG. 10 is a graph showing a relationship between ambient temperature and printing character size when the control of FIG. 8 is executed. FIG. 11 is a graph showing a relationship between temperature inside the heating device and ink temperature inside the nozzle. FIG. 12 is a graph showing a relationship between ink particle speed and printing character size. FIG. 13 is a graph showing a relationship between ink viscosity and ink particle speed.

In FIG. 4, when operation is started, each of the supply pump 4, the recovery pump 29, and the intensifying liquid pump 19 illustrated in FIG. 1 operates, the supply valve 3 and the ejection valve 7 open, and the ink of which the pressure is regulated at an arbitrary pressure by the pressure regulating valve 6 is supplied to the nozzle 9 via the heating device 8. Then, ink particles are ejected from the nozzle 9. This process (operation) is step S01 of FIG. 4.

Then, pressure pulsation is applied to the ink inside the nozzle 9 by a nozzle drive voltage (excitation voltage), and the ejected ink is atomized by the surface tension of the ink. The state of the ink particles (particle size or speed of the ink particles) is greatly affected by the ink viscosity in addition to the drive voltage and the surface tension of the ink, and affects printing characters. FIG. 13 shows a relationship between ink viscosity and ink particle speed, and FIG. 12 shows a relationship between ink particle speed and the printing character size. In addition, the ink viscosity is affected by the ink temperature. Namely, it can be seen that the ink viscosity decreases as the ink temperature increases, and the ink viscosity increases as the ink temperature decreases.

Next, in FIG. 4, in step S02, the ink temperature is detected. The measurement of temperature is performed by the thermistor 34 assembled in the heating device 8 illustrated in FIG. 2. Strictly speaking, the ink temperature detected by the thermistor is different from the temperature of the ink (ink particles) ejected from the nozzle 9; however, since the distance between the heating device 8 and the nozzle 9 is short, both the temperatures can be considered to be substantially the same temperature. However, in this embodiment, the relationship between the detected temperature of the thermistor and ink temperature inside the nozzle is obtained in advance as shown in FIG. 11, and the ink temperature inside the nozzle is estimated from the temperature of the thermistor to accurately obtain the ink temperature of the ink particles ejected from the nozzle 9.

Subsequently, in step S03, it is determined whether or not the ink temperature inside the nozzle 9 is a temperature close to the maximum value of a temperature range corresponding to the range of ink viscosity in which normal printing can be executed. In this embodiment, a value slightly smaller than the maximum value of the amount of use of the ink (hereinafter, referred to as a maximum proximity value) is selected as a set value. In this example, the temperature set value will be described as 45° C. Incidentally, temperature control can be performed as long as a set temperature when the heating device 8 performs heating is in the temperature range (in a usable temperature range) corresponding to the ink viscosity at which normal printing can be executed. However, when the set temperature is set too low, the range of temperature control becomes narrow, which is not preferable. When the set temperature is set between the median value and the maximum value of the range, the range in which temperature control is executed can be expanded, and the amount of use of the solvent can be reduced, which is preferable. When the ink temperature inside the nozzle 9 estimated based on the measurement (estimated from the relationship of FIG. 8) is lower than 45° C. that is set, the process proceeds to step S04. When the ink temperature has already reached 45° C. which is the set value, the process proceeds to step S05. Namely, the PTC heater 33 of the heating device 8 is heated by the heating device control circuit 46 to reach 45° C.

In step S04, heating control is executed such that the ink temperature reaches the set temperature. Namely, the heating device control circuit 46 performs control to heat the PTC heater 33 of the heating device 8 such that the temperature of the ink ejected from the nozzle 9 reaches 45° C. Specifically, control is performed as shown in FIG. 9. Since the ink viscosity is lowered by this heating control, even when the amount of use of the solvent is reduced, the ink viscosity can be controlled to be constant, and the amount of use of the solvent can be reduced. In addition, the heating device 8 has a quick effect in that the heating device 8 instantly raises the ink temperature, so that the ink temperature is quickly controlled, and the regulation of the ink viscosity of the ink to be supplied to the nozzle 9 is performed.

However, when ambient temperature is 45° C. or higher which is the set value, the ink viscosity cannot be controlled to be further lowered by temperature control. This embodiment is configured such that even in such a case, the ink viscosity can be controlled to be in the range of ink viscosity which enables normal printing. For this reason, steps S05 to S07 are executed. The ink viscosity can be controlled to be in the range, which enables normal printing, by steps S05 to S07.

Namely, even when the ink temperature exceeds 45° C. in step S04, the process proceeds to step S05, and the control of the ink viscosity is executed. First, in step S05, the ink viscosity is detected by the viscometer 14. As a result of the detection, when the ink viscosity is determined to be a viscosity out of the range in which normal printing is performed, the process proceeds to step S07.

In step S07, control is performed such that the intensifying liquid (solvent) in the intensifying liquid container 17 or the replenishment ink in the sub-ink container 25 is supplied to the main ink container 1 to adjust the ink viscosity at the predetermined value or in the predetermined range (range of ink viscosity in which normal printing can be executed). When the ink viscosity is higher than the predetermined value or a normal range, basically, the solvent is supplied. Then, when the ink viscosity is lower than the normal range, control is performed to supply the replenishment ink to adjust the ink viscosity of the ink 2*a* in the main ink container 1. This control can be performed without problem as long as the ink viscosity is in the range of ink viscosity in which normal printing can be executed, but in this embodiment, the control is performed until the ink viscosity reaches the median value of the range.

Namely, when the detection value of the viscometer 14 is lower than a viscosity value which is the median value of the normal printing range of the relationship between ambient temperature and ink viscosity as shown in FIG. 9, the ink 2*b* in the sub-ink container 25 is replenished to the main ink container 1 via the replenishment valve 15, the supply pump 4, the pressure regulating valve 6, the heating device 8, the nozzle 9, the gutter 11, and the recovery pump 29. In addition, when the detection value is higher than the viscosity value which is the median value of the normal printing range of the relationship between ambient temperature and ink viscosity shown in FIG. 9, the intensifying liquid 18 in the intensifying liquid container 17 is replenished to the main ink container 1 via the intensifying liquid pump 19 and the intensifying valve 20. This control is performed by the ink viscosity control circuit 48 (refer to FIG. 3), and the ink viscosity is controlled to reach the viscosity value which is the median value of the normal printing range. Printing is performed with the ink controlled at the ink temperature inside the nozzle 9 which is controlled at 45° C. in the vicinity of the maximum value of the usable temperature range, and at the ink viscosity in the vicinity of the median value of the normal printing range, so that characters can be stably printed. In addition, characters can be printed in a constant size without being affected by ambient temperature.

In step S08, characters are printed after such a process is performed. Namely, printing is performed in such a manner that the ink of which the ink viscosity is regulated is supplied to the nozzle 9, and the ink particles charged by the charging electrode 23 are deflected by the deflection electrode 24 to land on a printing object. In addition, non-charged ink particles among the ejected ink particles travel straight and are captured by the gutter 11 to return to the main ink container 1 via the recovery pump 29. This control is executed by the control unit illustrated in FIG. 3.

Next, in step S09, it is determined whether or not the scheduled printing is completed and stopped. If the scheduled printing work is not completed (when printing is desired to be continued), the process proceeds to step S02. When the scheduled printing work is completed, the operation is stopped.

(Regarding Reason for Setting Set Temperature High)

Here, in the above embodiment, the reason for setting the set value of temperature control high will be described in more detail. FIGS. 5 to 7 show a case where the set value of temperature control is set to a low value and ink temperature control is executed by the heating device when ambient temperature is a relatively low temperature. In FIG. 5, when ambient temperature is lower than the set value (for example, 15° C.), heating is performed such that the ink temperature is 15° C. However, when ambient temperature is higher than 15° C. which is the set value, the temperature cannot be controlled. In that case, the ink temperature depends on ambient temperature, the ink temperature cannot be controlled by the heating device. When control is performed in such a manner, as shown in FIG. 6, in an ink B having a steep gradient in relationship between ink temperature and ink viscosity, the ink viscosity is lower than the normal printing region and thus leading to a high possibility of printing failure. In addition, as shown in FIG. 7, in the case of the ink B having a steep gradient in relationship between ink temperature and ink viscosity, the character size increases depending on temperature (size of the ink particles forming characters increase), which is a problem. Incidentally, the reason the character size differs depending on temperature is that as shown in FIGS. 6, 12, and 13, there is a relationship that the ink viscosity changes depending on the ink temperature, the ink particle speed changes depending on the ink viscosity, and the printing character size changes depending on the ink particle speed.

On the other hand, when the set temperature is set to a high set value so as to be in a range from the median value to the median value of a usage temperature range (in the above-described embodiment, 45° C. is selected as the set value as shown in FIG. 8), as shown in FIG. 9, the range of temperature control is expanded, and even when ambient temperature greatly varies, the ink viscosity can be maintained in the normal range by heating control by the heating device 8. As a result, as shown in FIG. 10, the printing character size can be made constant. Therefore, the higher the temperature set value for temperature control is, the more optimally control can be performed. Naturally, when the ink viscosity is out of the range in which the ink viscosity can be handled by temperature control, the ink viscosity control circuit 48 (refer to FIG. 3) causes the solvent or the replenishment ink to be supplied to the main ink container 1 to control the ink viscosity of the ink 2*a*.

Effects of First Embodiment

As described above, in the first embodiment of the present invention described above, since control is performed in which the priority is given to ink temperature control by heating performed by the heating device, and the control of supplying the solvent and the replenishment ink to the main ink container is also used, the amount of use of the solvent can be reduced and normal printing can be performed. Namely, since ink viscosity control by temperature control is performed, the dependence of the ink viscosity control on the solvent can be reduced, and the ink temperature can be instantly raised to regulate the ink viscosity to an optimum level. Further, when the ink viscosity detected by the viscometer is out of the range of ink viscosity which enables normal printing, control is performed to supply the solvent and the replenishment ink to the main ink container according to the situation, so that normal printing can be always stably executed.

Incidentally, the present invention is not limited to the above-described embodiment, and various modifications can be made without departing from the technical concept of the present invention.

Second Embodiment

Figure 14:
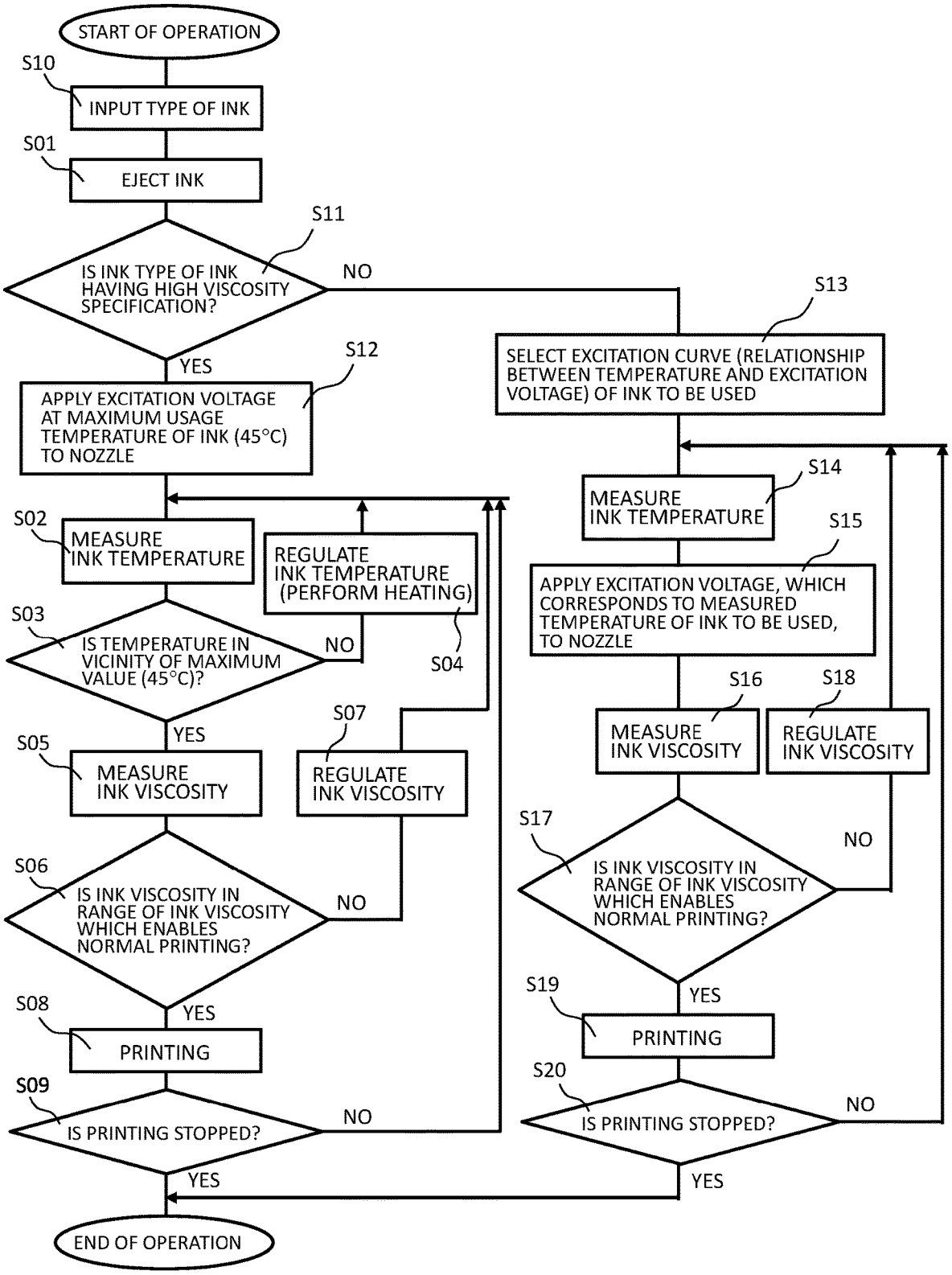
FIG. 14 is a flowchart illustrating control of an inkjet recording device according to a second embodiment of the present invention.
Figure 15:
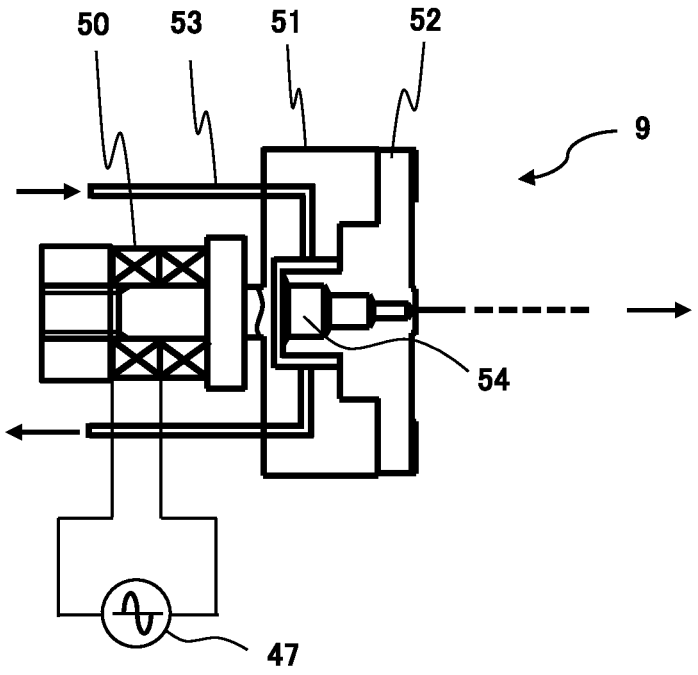
FIG. 15 is a view illustrating a configuration of a nozzle of the inkjet recording device.

Next, a second embodiment of the present invention will be described. In the second embodiment, the state of ink particles (particle size or speed of ink particles) ejected at the nozzle 9 is regulated to coincide with an ideal state, which is assumed in advance, by the control of the heating device 9. The entire configuration of an inkjet recording device in the second embodiment is the configuration of FIG. 1 which is the same as in the first embodiment. Since the configuration of FIG. 1 has already been described, duplicated descriptions will be omitted. FIG. 14 is a flowchart illustrating control of the inkjet recording device in the second embodiment of the present invention. In addition, FIG. 15 is a view illustrating a configuration of the nozzle 9 of the inkjet recording device.

First, before an operation of the second embodiment is described, the configuration of the nozzle 9 and the control of optimizing the state of ink particles ejected from the nozzle will be described with reference to FIG. 15. In FIG. 15, the nozzle 9 includes a piezoelectric element 50, a nozzle body 51, an orifice plate 52, and an ink flow path 53. The nozzle drive circuit 47 applies an excitation voltage to the piezoelectric element, and the piezoelectric element 50 is excited by the excitation voltage (nozzle drive voltage) to cause pressure pulsation in an ink flowing in the ink flow path 53. Accordingly, after an ink 54 is ejected from the nozzle body 51 and the orifice plate 52, the ink is atomized by surface tension, and ink particles are ejected. At this time, when the excitation voltage is too large or too small, the state of the ink particles is not optimized. When printing is performed with such ink particles, printing quality deteriorates. For this reason, in a general control method performed in the related art, the control unit controls the nozzle drive circuit 47 to regulate the excitation voltage and thus controls the state of the ink particles to be optimized. However, since the state of the ink particles greatly changes depending on ink viscosity, it is necessary to regulate the excitation voltage to correspond to a variation in ink viscosity, and it is difficult to frequently control the excitation voltage such that the ink particles are in an optimum state.

In light of such a situation, in the second embodiment of the present invention, in taking advantage of the fact that the state of ink particles ejected from the nozzle 9 varies depending on ink viscosity and the ink viscosity can change depending on ink temperature, the excitation voltage is set to a constant voltage determined by the type of an ink to be used, and the ink temperature is regulated by the heating device to regulate the ink viscosity during operation to an optimum level to optimize the state of the ink particles.

Next, a control operation in the second embodiment of the present invention will be described in detail with reference to FIG. 14. In FIG. 14, the same reference signs are assigned to the same operations as in FIG. 4, which represent the control operation of the first embodiment which has already been described. For this reason, in FIG. 14, the description of the process flows to which the same reference signs as in FIG. 4 are assigned will be omitted.

In FIG. 14, when operation is started, first, the type of an ink to be used (ink in the main ink container 1) is input. The input of the type of the ink (whether the ink has a high viscosity or a low viscosity) may be an input from the operation display unit 44 of the control unit illustrated in FIG. 3 by an operator, or may be performed in such a manner that information regarding the type of the ink displayed on a label or the like of an ink bottle is automatically read out on a device side. This operation is step S10. After step S10, the process proceeds to step S01.

In step S01, the ink is supplied to the nozzle 9, and ink particles are ejected from the nozzle. The operation of step S01 is the same operations as step S01 of FIG. 4 which has already been described. After the operation of step S01, the process proceeds to step S11.

In step S11, it is determined whether or not the ink has a high viscosity specification, based on a determination criterion determined in advance as to whether or not the ink viscosity is a high viscosity. Regarding the determination criterion, a reference viscosity is determined which is a determination criterion, and when the viscosity is the reference viscosity or higher, the viscosity is determined to be a high viscosity. As a result of the determination, when the ink is determined to have a high viscosity specification (the case of YES in step S11), the process proceeds to step S12. In the determination, when the ink is determined not to have a high viscosity specification (the case of NO in step S11), the process proceeds to step S13. Here, the reason for distinguishing between a high viscosity ink and a non-high viscosity ink is that in the case of a high-viscosity ink, in order to reduce the use of the solvent as much as possible, the control of setting temperature in the vicinity of the maximum usage temperature of the ink is performed. In the case of a relatively low viscosity, in order to relax the limitation, the excitation curve of the ink is used which is obtained in advance and represents a relationship between temperature and excitation voltage.

In step S12, the excitation voltage is set such that an excitation voltage at temperature in the vicinity of the maximum usage temperature of the ink (45° C.) is applied to the nozzle. Namely, the excitation voltage at which the ink particles are in an appropriate state in the vicinity of the maximum value (45° C. in this example) of the usage temperature of the ink having a high viscosity specification is set to be supplied to the piezoelectric element 50 of the nozzle 9. After this process, the process proceeds to step S02.

In step S13, the excitation curve (relationship between temperature and excitation voltage) of the ink used which is obtained in advance is selected, and the process proceeds to step S14. In step S14, the ink temperature inside the heating device is measured. In step S15, the measured ink temperature is used to set the excitation voltage such that an excitation voltage corresponding to the measured temperature of the ink used is applied to the nozzle. Namely, the excitation voltage at which the ink particles of the ink used are in an appropriate state is set to be supplied to the piezoelectric element 50 of the nozzle 9. After this process, the process proceeds to step S16.

Since the operation processes of steps S02 to S09 have been described in FIG. 4, only a brief description will be give here. Namely, in step S02, the ink temperature is measured, and in step S03, it is determined whether or not the temperature is the set temperature (45° C. in this embodiment) set in the vicinity of the maximum temperature of the ink. When the temperature is the set temperature or lower, the process proceeds to step S04, and the heating device 8 is controlled to regulate the ink temperature (perform heating) to the set temperature. When the temperature reaches the set temperature, the process proceeds to step S05. In step S05, the ink viscosity is measured by the viscometer 14, and in step S06, it is determined whether or not the ink viscosity is in the range of viscosity which enables printing. When the ink viscosity is not in the range which enables printing (case of NO), the process proceeds to step S07, and the control of regulating the ink viscosity is executed. When the ink viscosity is in the range which enables printing in step S06 (case of YES), the process proceeds to step S08, and printing is executed. Then, when predetermined printing work is completed (case of YES in step S09), the operation of the device ends.

In step S16, similar to step S05, the ink viscosity is measured. In step S17, similar to step S06, it is determined whether or not the ink is in the viscosity range which enables printing, and when the ink viscosity is not in the range which enables printing (case of NO), the process proceeds to step S18, and the control of regulating the ink viscosity is executed.

When the ink viscosity is in the range which enables printing in step S17 (case of YES), the process proceeds to step S19, and printing is executed. Then, when predetermined printing work is completed (case of YES in step S20), the operation of the device ends.

Effects of Second Embodiment

According to the second embodiment, the same effects as in the first embodiment can be obtained, and ink heating control can be performed by the heating device to control the state of the ink particles at the nozzle to an optimum state for printing. Accordingly, even when the excitation voltage is not regulated, ink particles with which optimum printing can be performed can be ejected from the nozzle 9.

REFERENCE SIGNS LIST

1 Main ink container
2*a* Ink
2*b* Replenishment ink
3 Supply valve
4 Supply pump
5 Main filter
6 Pressure regulating valve
7 Ejection valve
8 Heating device
9 Nozzle
10 Ink particle
11 Gutter
12 Diffusion valve
13 Ink recovery pipe
14 Viscometer
15 Replenishment valve
16 Ink replenishment pipe
17 Intensifying liquid container
18 Intensifying liquid
19 Intensifying liquid pump
20 Intensifying valve
21 Intensifying liquid replenishment pipe
22 Discharge pipe
23 Charging electrode
24 Deflection electrode
25 Sub-ink container
26 Printing object
27 Circulation valve
28 Circulation pump
29 Recovery pump
30 Ink supply pipe
31 Heating block
32 Block lid
33 PTC heater
34 Thermistor
35 Ink chamber
36 Heater plate
37 Elastic member
40 MPU
41 Charging signal generation circuit
42 ROM
43 RAM
44 Operation display unit
45 Video RAM
46 Heating device control circuit
47 Nozzle drive circuit
48 Ink viscosity control circuit
50 Piezoelectric element
51 Nozzle body
52 Orifice plate
53 Ink flow path

The invention claimed is:

1. An inkjet recording device comprising:

a nozzle that atomizes an ink to eject ink particles;

a charging electrode that charges the ink particles, which have been ejected from the nozzle, to correspond to a printing character;

a deflection electrode that deflects the charged ink particles which have passed through the charging electrode;

a gutter that captures a non-charged ink;

an ink supply path that supplies the ink in a main ink container to the nozzle;

an ink recovery path that recovers the non-charged ink, which has been captured by the gutter, to the main ink container;

a solvent replenishment unit that supplies a solvent to the main ink container;

a control unit that controls an entirety of the device;

a heating device that is installed between the ink supply path and the nozzle to heat the ink;

a thermometer that detects an ink temperature of the ink heated by the heating device; and a viscometer that detects a viscosity of the ink in the main ink container are provided, wherein the control unit controls the heating device based on the temperature detected by the thermometer such that the temperature reaches a set temperature set in a range of an ink viscosity which enables printing, and controls an amount of supply of the solvent based on a detection value of the viscometer to regulate the viscosity of the ink in the main ink container to a predetermined ink viscosity, and wherein the control unit determines whether or not the ink to be used has a high viscosity specification, based on a determination criterion determined in advance as to whether or not the viscosity is high, applies an excitation voltage, which corresponds to a maximum usage temperature of the ink, to the nozzle when the viscosity is determined to be high, and applies a second excitation voltage, which corresponds to the ink temperature, to the nozzle when the viscosity is determined not to be high.

2. The inkjet recording device according to claim 1, wherein the set temperature is in a range from a median value to a maximum value of a usage temperature range corresponding to the range of the ink viscosity which enables printing.

3. The inkjet recording device according to claim 1, wherein the control unit controls the solvent replenishment unit to supply the solvent to the main ink container such that the viscosity reaches a median value of the range of the ink viscosity which enables printing.

4. The inkjet recording device according to claim 1, wherein an auxiliary ink supply unit is provided which supplies an auxiliary ink to the main ink container, and the solvent or the auxiliary ink is supplied to the main ink container to regulate the viscosity to the predetermined ink viscosity.

5. The inkjet recording device according to claim 1, wherein the control unit applies the excitation voltage, which corresponds to the ink to be used, to the nozzle, sets the set temperature to a temperature at which a state of the ink particles is suitable at the excitation voltage, and controls the heating device.

6. A method for controlling an inkjet recording device including a nozzle that atomizes an ink to eject ink particles, a charging electrode that charges the ink particles, which have been ejected from the nozzle, to correspond to a printing character, a deflection electrode that deflects the charged ink particles which have passed through the charging electrode, a gutter that captures a non-charged ink, an ink supply path that supplies the ink in a main ink container to the nozzle, an ink recovery path that recovers the non-charged ink, which has been captured by the gutter, to the main ink container, and a solvent supply unit that supplies a solvent to the main ink container, wherein a heating device that is installed between the ink supply path and the nozzle to heat the ink, a thermometer that detects a temperature of the ink heated by the heating device, and a viscometer that detects a viscosity of the ink in the main ink container are provided, the method comprising:

controlling the heating device based on a set temperature set in a range of an ink viscosity which enables normal printing and the temperature of the ink detected by the thermometer, and performing control such that the solvent or the replenishment ink is supplied to the main ink container based on a detection value of the viscometer to cause the viscosity to be in the range which enables printing; and determining whether or not the ink to be used has a high viscosity specification, based on a determination criterion determined in advance as to whether or not the viscosity is high, applying an excitation voltage corresponding to a maximum usage temperature of the ink to the nozzle when the viscosity is determined to be high, and applying the excitation voltage corresponding to the temperature of the ink to the nozzle when the viscosity is determined not to be high.

7. The method for controlling an inkjet recording device according to claim 6, wherein the set temperature is in a range from a median value to a maximum value of a usage temperature range corresponding to the range of the ink viscosity which enables normal printing.

8. The method for controlling an inkjet recording device according to claim 6, further comprising the step of:

performing control is to supply the solvent to the main ink container such that the viscosity reaches a median value of the range which enables normal printing.

9. The method for controlling an inkjet recording device according to claim 6, further comprising the step of:

supplying the solvent or an auxiliary ink from an auxiliary ink supply unit to the main ink container to regulate the viscosity to a predetermined ink viscosity.

10. The method for controlling an inkjet recording device according to claim 6, further comprising the steps of:

applying the excitation voltage corresponding to the ink to be used to the nozzle, setting the set temperature to a temperature at which a state of the ink particles is suitable at the excitation voltage, and controlling the heating device.

* * * * *